US010793934B2

(12) United States Patent
Kaplan et al.

(10) Patent No.: US 10,793,934 B2
(45) Date of Patent: Oct. 6, 2020

(54) COMPOSITION AND METHOD FOR ENHANCED PRECIPITATION HARDENED SUPERALLOYS

(71) Applicant: United Technologies Corporation, Farmington, CT (US)

(72) Inventors: Max A. Kaplan, West Hartford, CT (US); Xuan Liu, Glastonbury, CT (US); David Ulrich Furrer, Marlborough, CT (US)

( * ) Notice: Subject to any disclaimer, the term of this patent is extended or adjusted under 35 U.S.C. 154(b) by 653 days.

(21) Appl. No.: 15/584,912

(22) Filed: May 2, 2017

(65) Prior Publication Data

US 2018/0320254 A1 Nov. 8, 2018

(51) Int. Cl.

| | |
|---|---|
| ***C22C 30/00*** | (2006.01) |
| ***F01D 5/28*** | (2006.01) |
| ***C22C 19/05*** | (2006.01) |
| ***F04D 29/02*** | (2006.01) |

(52) U.S. Cl.

CPC ..... *C22C 30/00* (2013.01); *C22C 19/05* (2013.01); *C22C 19/058* (2013.01); *F01D 5/28* (2013.01); *F04D 29/023* (2013.01); *F05D 2240/20* (2013.01); *F05D 2300/175* (2013.01)

(58) Field of Classification Search

None

See application file for complete search history.

(56) References Cited

U.S. PATENT DOCUMENTS

| | | | | |
|---|---|---|---|---|
| 3,061,426 | A | 10/1962 | Bieber | |
| 4,288,259 | A | 9/1981 | Pearson et al. | |
| 4,589,937 | A | 5/1986 | Jackson et al. | |
| 4,981,644 | A * | 1/1991 | Chang | C22C 19/055 148/410 |
| 5,207,846 | A | 5/1993 | Kelly | |
| 6,974,508 | B1 | 12/2005 | Gabb et al. | |
| 8,147,749 | B2 | 4/2012 | Reynolds | |
| 8,734,716 | B2 * | 5/2014 | Harada | C22C 19/055 420/438 |
| 2016/0090878 | A1 | 3/2016 | Muralidharan | |

FOREIGN PATENT DOCUMENTS

| | | |
|---|---|---|
| EP | 1193321 A1 | 4/2002 |
| EP | 1195446 A1 | 4/2002 |
| EP | 1801251 A1 | 6/2007 |
| EP | 2256223 A1 | 12/2010 |

OTHER PUBLICATIONS

D. Krueger, "The Development of Direct Age 718 for Gas Turbine Engine Disk Applications", from The Minerals, Metals & Materials Society, pp. 279-296, 1989.

X. Liang, et al., "The Structure and Mechanical Properties of Alloy 718 DA Disk on Hammer", from The Minerals, Metals & Materials Society, pp. 957-966, 1994.

Extended European Search Report for EP Application No. 18169918.2, dated Oct. 1, 2018, 7 pages.

* cited by examiner

*Primary Examiner* — Colleen P Dunn
*Assistant Examiner* — Michael J Kachmarik
(74) *Attorney, Agent, or Firm* — Kinney & Lange, P.A.

(57) ABSTRACT

An embodiment of a superalloy composition includes 1.5 to 4.5 wt % Al; 0.005 to 0.06 wt % B; 0.02 to 0.07 wt % C; 21.0 to 26.0 wt % Co; 11.5 to 16.0 wt % Cr; 8.50 to 19.0 wt % Ta; 0.005-0.10 wt % Zr; and balance Ni and incidental impurities.

12 Claims, 2 Drawing Sheets

COMPOSITION AND METHOD FOR ENHANCED PRECIPITATION HARDENED SUPERALLOYS

BACKGROUND

The disclosed subject matter relates generally to alloy compositions and methods, and more particularly to compositions and methods for superalloys.

Advanced cast and wrought nickel superalloys permit significantly higher strength, but in some cases do not possess the same temperature capability as powder processed alloys. Many cast and wrought material systems utilize different strengthening mechanisms or implement strengthening mechanisms differently than powder alloys, and for this reason are often limited to lower temperature applications. Thus many currently known cast and wrought nickel superalloys are seen as less desirable for certain applications where both high thermal and mechanical stresses are present, but may be utilized provided the appropriate implementation of strengthening mechanisms.

SUMMARY

An embodiment of a superalloy composition includes 1.5 to 4.5 wt % Al; 0.005 to 0.06 wt % B; 0.02 to 0.07 wt % C; 21.0 to 26.0 wt % Co; 11.5 to 16.0 wt % Cr; 8.50 to 19.0 wt % Ta; 0.005-0.10 wt % Zr; and balance Ni and incidental impurities.

An embodiment of a component for a gas turbine engine is formed from a superalloy composition that includes 1.5 to 4.5 wt % Al; 0.005 to 0.06 wt % B; 0.02 to 0.07 wt % C; 21.0 to 26.0 wt % Co; 11.5 to 16.0 wt % Cr; 8.50 to 19.0 wt % Ta; 0.005-0.10 wt % Zr; and balance Ni and incidental impurities.

DETAILED DESCRIPTION

Figure 1:
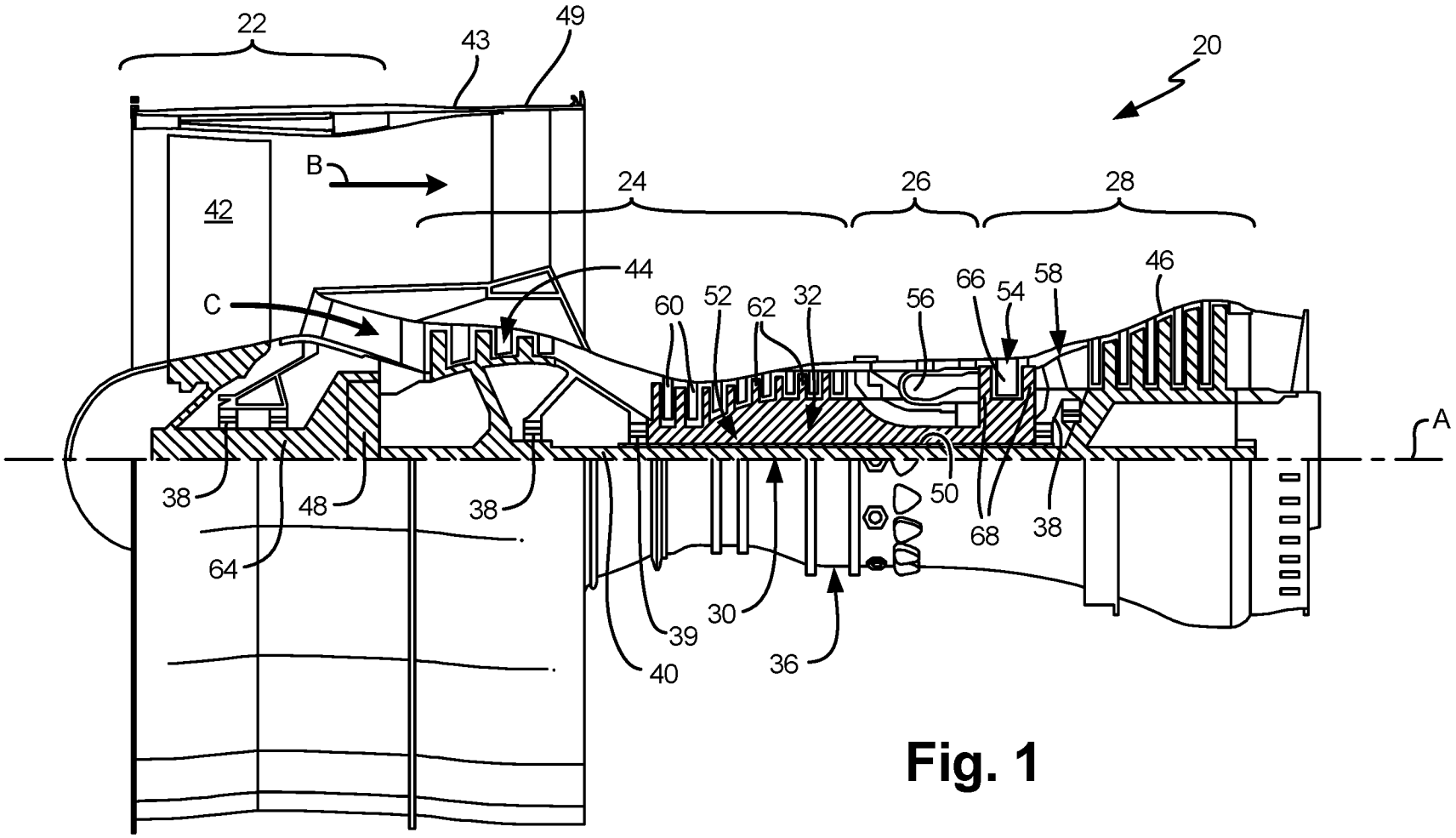
FIG. 1 shows a quarter-sectional schematic view of a gas turbine engine.

FIG. 1 shows gas turbine engine 20, for which components comprising the disclosed alloy can be formed. FIG. 1 schematically illustrates a gas turbine engine 20. Gas turbine engine 20 is a two-spool turbofan gas turbine engine that generally includes fan section 22, compressor section 24, combustion section 26, and turbine section 28. Other examples may include an augmentor section (not shown) among other systems or features. Fan section 22 drives air along bypass flowpath B while compressor section 24 drives air along a core flowpath C. Compressed air from compressor section 24 is directed into combustion section 26 where the compressed air is mixed with fuel and ignited. The products of combustion exit combustion section 26 and expand through turbine section 28.

Although the disclosed non-limiting embodiment depicts a two-spool turbofan gas turbine engine, it should be understood that the concepts described herein are not limited to use with two-spool turbofans as the teachings may be applied to other types of turbine engines; for example, an industrial gas turbine; a reverse-flow gas turbine engine; and a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

Gas turbine engine 20 generally includes low-speed spool 30 and high-speed spool 32 mounted for rotation about a center axis A relative to engine static structure 36. Low-speed spool 30 and high-speed spool 32 are rotatably supported by bearing systems 38 and thrust bearing system 39. Low-speed spool 30 interconnects fan 42, low-pressure compressor (LPC) 44, and low-pressure turbine (LPT) 46. Low-speed spool 30 generally includes inner shaft 40, geared architecture 48, and fan drive shaft 64. Fan 42 is connected to fan drive shaft 64. Inner shaft 40 is connected to fan drive shaft 64 through geared architecture 48 to drive fan 42 at a lower speed than the rest of low-speed spool 30. Fan 42 is considered a ducted fan as fan 42 is disposed within duct 49 formed by fan case 43. Geared architecture 48 of gas turbine engine 20 is a fan drive gear box that includes an epicyclic gear train, such as a planetary gear system or other gear system. The example epicyclic gear train has a gear reduction ratio of greater than about 2.3 (2.3:1).

High-speed spool 32 includes outer shaft 50 that interconnects high-pressure compressor (HPC) 52 and high-pressure turbine (HPT) 54. Combustion section 26 includes a circumferentially distributed array of combustors 56 generally arranged axially between high-pressure compressor 52 and high-pressure turbine 54. In gas turbine engine 20, the core airflow C is compressed by low-pressure compressor 44 then high-pressure compressor 52, mixed and burned with fuel in combustors 56, then expanded over the high-pressure turbine 54 and low-pressure turbine 46. High-pressure turbine 54 and low-pressure turbine 46 rotatably drive high-speed spool 32 and low-speed spool 30 respectively in response to the expansion.

Mid-turbine frame 58 of engine static structure 36 is generally arranged axially between high-pressure turbine 54 and low-pressure turbine 46, and supports bearing systems 38 in the turbine section 28. Inner shaft 40 and outer shaft 50 are concentric and rotate via bearing systems 38 and thrust bearing system 39 about engine center axis A, which is collinear with the longitudinal axes of inner shaft 40 and outer shaft 50.

HPC 52 comprises vanes 60, which are stationary and extend radially inward toward shafts 40, 50. In order to expand the performance range of engine 10, one or more sets of variable stator vanes can optionally be used in high pressure compressor 52. Blades 62, which rotate with HPC 52 on outer shaft 50, are positioned adjacent vanes 60. Blades 62 sequentially push core air C past vanes 60 within HPC 52 to increase the pressure of core air C before entering combustor 56. Blades 62 are supported circumferentially around individual rotor disks.

Similarly, HPT 54 comprises one or more sets (or stages) of vanes 66, which are stationary and extend radially inward toward outer shaft 50. HPT blades 68 rotate with HPT 54, also on outer shaft 50, and are positioned adjacent vanes 66. Blades 68 are driven by core air C exiting combustor 56 with flow straightened by vanes 66 to optimize the amount of work captured. Blades 68 are also supported circumferentially around individual rotor disks, an example of which is shown in FIG. 2.

Figure 2:
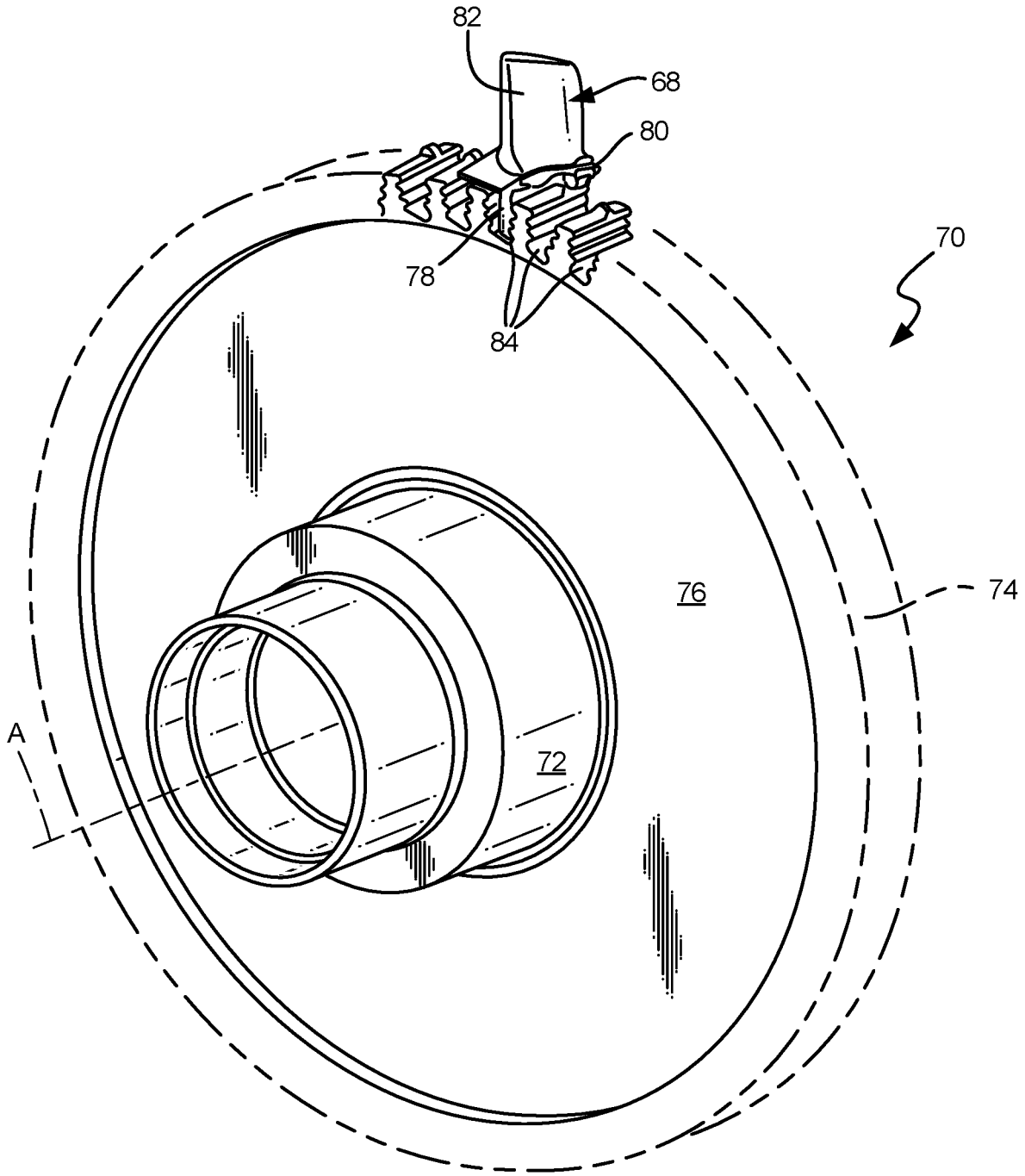
FIG. 2 depicts a perspective view of a typical rotor disk.

FIG. 2 is a perspective view of disk 70, which can either be a HPC disk, HPT disk, or any other disk. For the embodiment of engine 20 shown, it should be understood that a multiple of disks may be contained within each engine section and that although a turbine rotor disk 70 is illustrated and described in the disclosed embodiment, other engine sections will also benefit herefrom.

With reference to FIG. 2, a rotor disk 70 such as that provided within the high pressure turbine 54 (see FIG. 1) generally includes a plurality of blades 68 circumferentially disposed around rotor disk 70. The rotor disk 70 generally includes hub 72, rim 74, and web 76 which extends therebetween. Each blade 68 generally includes attachment section 78, platform section 80 and airfoil section 82. Each of the blades 68 is received within a respective rotor blade slot 84 formed within rim 74 of rotor disk 70.

Advanced engine architectures generally require large disk bores in high pressure stages (immediately upstream or downstream of the combustor) to accommodate the high stresses developed in such architectures. The development of an alloy that possesses both sufficient temperature capability for HPC/HPT disk applications and improved strength enables significant reduction in the size/weight of rotors, reducing weight of rotating hardware, therefore increasing performance and overall efficiency. Thus, it will be appreciated that the disclosure can also apply to rotor disk(s) for high pressure turbine 54, as well as any other stages or engine components which would be expected to be subject to combinations of thermal and mechanical stresses comparable to those seen particularly in the HPC and HPT rotor disks of advanced turbofan engine architectures.

Precipitation hardened nickel-based superalloys such as those disclosed herein are primarily formulated to maximize yield strength while minimizing effects at sustained high operating temperatures. The yield strength is primarily derived from gamma prime precipitation strengthening, and the alloy composition generally optimizes for this mechanism. However, the composition also adds misfit strain strengthening, grain boundary strengthening, and moderate solid solution (i.e., gamma phase) strengthening.

The alloy composition ranges, as well as nominal or target concentrations of constituent elements (on a weight percent basis) is shown in Table 1 below.

TABLE 1

Composition of The Disclosed Alloy

| | Composition (wt %) | | |
|---|---|---|---|
| Element | Minimum | Nominal | Maximum |
| Al | 1.5 | 1.85 | 4.5 |
| B | 0.005 | 0.008 | 0.06 |
| C | 0.02 | 0.03 | 0.07 |
| Co | 21.0 | 23.0 | 26.0 |
| Cr | 11.5 | 11.8 | 16.0 |
| Ta | 8.50 | 18.6 | 19.00 |
| Zr | 0.005 | 0.006 | 0.10 |
| Ni | | Balance | |

The ranges and nominal values of constituent elements are selected to provide each of the above properties, while also controlling negative effects from excess concentrations. In these alloys, minimum amounts of chromium primarily provide acceptable corrosion resistance, as well as minimum aluminum to stabilize the gamma prime precipitate phase. At the same time, chromium above the defined maximum limit can begin to cause unwanted phase destabilization and formation of undesirable brittle phases, reducing yield strength and ultimate tensile strength. Aluminum is also limited to control the total amount of precipitate phase and therefore enable an optimal size distribution of the gamma prime precipitate for maximizing strength. Tantalum can be modified within this range to balance cost, density, and strength. Tantalum content above the defined maximum limit can prevent effective heat treatment by increasing the alloy solvus temperature to above the incipient melting temperature, making solutionizing impossible. Tantalum content below the defined limit may not achieve sufficient precipitation hardening to enable high yield strength capability.

Increasing the matrix/precipitate anti-phase boundary (APB) energy and increasing the matrix/precipitate misfit strain can be achieved by addition of tantalum in at least the amounts shown. This adds to the strength of the material by optimizing other properties to fully take advantage of the benefits of the gamma prime precipitate phase. Increasing APB energy increases the energy penalty for shearing of the gamma prime precipitate by way of dislocations, therefore providing strength. Increasing misfit strain creates coherency strain fields at the precipitate/matrix interface, also providing strength.

Cobalt in at least the disclosed minimum amount increases the partitioning of Ta to the gamma-prime precipitate phase, further increasing APB energy and misfit strain, and therefore increasing strength. Co also assists in stabilizing the gamma prime precipitate phase. Residual Ta in the gamma phase also provides solid solution strengthening. But maximum limits on tantalum are provided to control the solvus temperature and keep the alloy system heat-treatable without localized premature microstructural melting.

In addition, B, C, Zr in relatively small amounts also enhance grain boundary strength, but should be limited to the maximum disclosed amounts in order to minimize brittle grain boundary film formation.

Nominal (or target) values represent a balance of the above factors, among others, to achieve a high yield strength manufacturable component suitable for the thermal and mechanical demands of high pressure compressor and turbine disks.

Certain known alloys, such as NWC, NF3 and ME16 rely on non-incidental amounts of Hf, Mo, Nb, Ti, and/or W to provide properties suitable for formation or post-processing of these alloys. These and other known alloy systems utilize one or more such elements to provide increased precipitation strengthening or solid solution strengthening. However, it has been found that this can be achieved primarily or exclusively through increased addition of Ta. Addition of Hf, Mo, Nb, Ti, and/or W are not necessarily superfluous in these known alloy systems, but their loss or omission can allow for increased Ta. Thus, certain embodiments of the disclosed alloy omit one or more of these elements, except in non-incidental amounts (e.g., from reprocessing scrap) due to the goals outlined herein.

Table 2 shows yield strength of a particular embodiment of the disclosed alloy composition. Specifically, the data relates to an alloy having the nominal composition shown in Table 1 above.

| Temperature | Property | Value |
|---|---|---|
| 75° F./24° C. | Hardness (Rockwell C) | 52.55 |
| | Yield Strength (ksi) | 204.2 |
| | Ultimate Tensile Strength (ksi) | 277 |
| 1300° F./704° C. | Yield Strength (ksi) | 185.5 |
| | Ultimate Tensile Strength (ksi) | 187.9 |

Commercial applications increasingly demand very high bore strength materials. The high temperature materials that exist today for this application, such as powder metallurgy processed nickel superalloys, are generally capable of meeting bore strengths needed. However, often times such rotors require large volume bore regions to be able to manage stresses. Increasing bore size can also often lead to increased part weight, forging sizes, manufacturing risks, and debited material strengths. Advanced cast and wrought nickel superalloys such as DA718 permit significantly higher strength, and for this reason help manage rotor bore sizes, but do not possess the same temperature capability as gamma prime strengthened alloys. This is because material systems such as DA718 utilize different strengthening mechanisms, and for this reason are limited to lower temperature applications. For future rotor applications a high strength alloy, with temperature capability and strengthening mechanisms similar to powder processed nickel superalloys, will be necessary in order to manage the size of disk bores.

Further, the disclosed alloy also solves the manufacturability problems with large disk shapes, which require larger forging sizes. Larger forgings are more difficult to manufacture because achievable microstructures are limited by cooling rates during heat treatment. Reducing the size of the final rotor effectively limits the size of forging shapes, and therefore makes forgings more heat treatable. This makes optimal cooling rates, and therefore optimal microstructures, more achievable.

Discussion of Possible Embodiments

The following are non-exclusive descriptions of possible embodiments of the present invention.

An embodiment of a superalloy composition includes 1.5 to 4.5 wt % Al; 0.005 to 0.06 wt % B; 0.02 to 0.07 wt % C; 21.0 to 26.0 wt % Co; 11.5 to 16.0 wt % Cr; 8.50 to 19.0 wt % Ta; 0.005-0.10 wt % Zr; and balance Ni and incidental impurities.

The composition of the preceding paragraph can optionally include, additionally and/or alternatively, any one or more of the following features, configurations and/or additional components:

A superalloy composition according to an exemplary embodiment of this disclosure, among other possible things includes 1.5 to 4.5 wt % Al; 0.005 to 0.06 wt % B; 0.02 to 0.07 wt % C; 21.0 to 26.0 wt % Co; 11.5 to 16.0 wt % Cr; 8.50 to 19.0 wt % Ta; 0.005-0.10 wt % Zr; and balance Ni and incidental impurities.

A further embodiment of the foregoing composition, wherein the composition excludes one or more of Hf, Mo, Nb, Ti, W in non-incidental amounts.

A further embodiment of any of the foregoing compositions, wherein the composition includes 1.85 wt % Al.

A further embodiment of any of the foregoing compositions, wherein the composition includes 0.008 wt % B.

A further embodiment of any of the foregoing compositions, wherein the composition includes 0.03 wt % C.

A further embodiment of any of the foregoing compositions, wherein the composition includes 23.0 wt % Co.

A further embodiment of any of the foregoing compositions, wherein the composition includes 11.8 wt % Cr.

A further embodiment of any of the foregoing compositions, wherein the composition includes 18.6 wt % Ta.

A further embodiment of any of the foregoing compositions, wherein the composition includes 0.006 wt % Zr.

An embodiment of a component for a gas turbine engine is formed from a superalloy composition that includes 1.5 to 4.5 wt % Al; 0.005 to 0.06 wt % B; 0.02 to 0.07 wt % C; 21.0 to 26.0 wt % Co; 11.5 to 16.0 wt % Cr; 8.50 to 19.0 wt % Ta; 0.005-0.10 wt % Zr; and balance Ni and incidental impurities.

The component of the preceding paragraph can optionally include, additionally and/or alternatively, any one or more of the following features, configurations and/or additional components:

A component for a gas turbine engine according to an exemplary embodiment of this disclosure, among other possible things is formed from a superalloy composition that includes 1.5 to 4.5 wt % Al; 0.005 to 0.06 wt % B; 0.02 to 0.07 wt % C; 21.0 to 26.0 wt % Co; 11.5 to 16.0 wt % Cr; 8.50 to 19.0 wt % Ta; 0.005-0.10 wt % Zr; and balance Ni and incidental impurities.

A further embodiment of the foregoing component, wherein the component is a rotor disk for a compressor section or a turbine section of the gas turbine engine.

A further embodiment of any of the foregoing components, wherein the rotor disk is adapted to be installed in a high pressure compressor section or a high pressure turbine section of the gas turbine engine, immediately upstream or immediately downstream of a combustor section.

A further embodiment of any of the foregoing components, wherein the composition excludes one or more of Hf, Mo, Nb, Ti, W in non-incidental amounts.

A further embodiment of any of the foregoing components, wherein the composition includes 1.85 wt % Al.

A further embodiment of any of the foregoing components, wherein the composition includes 0.008 wt % B.

A further embodiment of any of the foregoing components, wherein the composition includes 0.03 wt % C.

A further embodiment of any of the foregoing components, wherein the composition includes 23.0 wt % Co.

A further embodiment of any of the foregoing components, wherein the composition includes 11.8 wt % Cr.

A further embodiment of any of the foregoing components, wherein the composition includes 18.6 wt % Ta.

A further embodiment of any of the foregoing components, wherein the composition includes 0.006 wt % Zr.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A superalloy composition consisting essentially of:
1.5 to 4.5 wt % Al;
0.005 to 0.06 wt % B;
0.02 to 0.07 wt % C;
23.0 to 26.0 wt % Co;
11.8 to 16.0 wt % Cr;
18.6 to 19.0 wt % Ta;
0.005-0.10 wt % Zr; and
balance Ni and incidental impurities;
wherein the composition excludes Hf, Mo, Nb, Ti, and W in amounts greater than amounts occurring incidentally in the composition.

2. The composition of claim 1, wherein the composition includes 1.85 wt % Al.

3. The composition of claim 1, wherein the composition includes 0.008 wt % B.

4. The composition of claim 1, wherein the composition includes 0.03 wt % C.

5. The composition of claim 1, wherein the composition includes 0.006 wt % Zr.

6. A gas turbine engine component formed from an alloy having a composition comprising essentially of:

1.5 to 4.5 wt % Al;
0.005 to 0.06 wt % B;
0.02 to 0.07 wt % C;
23.0 to 26.0 wt % Co;
11.8 to 16.0 wt % Cr;
18.6 to 19.0 wt % Ta;
0.005-0.10 wt % Zr; and
balance Ni and incidental impurities;
wherein the composition excludes Hf, Mo, Nb, Ti, and W in amounts greater than amounts occurring incidentally in the composition.

7. The component of claim 6, wherein the component is a rotor disk for a compressor section or a turbine section of the gas turbine engine.

8. The component of claim 7, wherein the rotor disk includes mechanical, thermal, and structural properties suitable in a high pressure compressor section or a high pressure turbine section of the gas turbine engine, immediately upstream or immediately downstream of a combustor section.

9. The component of claim 6, wherein the composition includes 1.85 wt % Al.

10. The component of claim 6, wherein the composition includes 0.008 wt % B.

11. The component of claim 6, wherein the composition includes 0.03 wt % C.

12. The component of claim 6, wherein the composition includes 0.006 wt % Zr.

* * * * *